United States Patent [19]

Yoshiyuki

[11] 4,400,044

[45] Aug. 23, 1983

[54] MODULAR CABINET SYSTEM

[75] Inventor: Hidetoshi Yoshiyuki, Bridgewater, N.J.

[73] Assignee: Takara Company, Somerset, N.J.

[21] Appl. No.: 246,855

[22] Filed: Mar. 23, 1981

[51] Int. Cl.[3] ..... A47B 67/00; A47G 1/00

[52] U.S. Cl. ..... 312/204; 312/224; 312/226; 108/64

[58] Field of Search ..... 312/204, 224, 225, 226, 312/227, 107, 111, 198, 194, 7.2, 262; 108/64; 248/289.1

[56] References Cited

U.S. PATENT DOCUMENTS

| | | | |
|---|---|---|---|
| 265,548 | 10/1882 | Spear | 312/224 |
| 344,132 | 6/1886 | Palmer | 312/224 |
| 1,071,599 | 8/1913 | Bachara | 312/226 |
| 1,798,800 | 3/1931 | MacKnight | 312/198 |
| 2,584,869 | 2/1952 | Gunder | 312/198 |
| 2,694,614 | 11/1954 | Dent | 108/64 |
| 3,029,118 | 4/1962 | Schuette | 312/194 |
| 3,413,053 | 11/1968 | Featherston | 312/194 |
| 3,964,401 | 6/1976 | Gutmann, Jr. et al. | 108/64 |
| 4,049,331 | 9/1977 | Gutmann, Jr. | 312/198 |
| 4,080,022 | 3/1978 | Canfield et al. | 108/64 |
| 4,258,964 | 3/1981 | Cowen, Jr. et al. | 312/224 |
| 4,274,685 | 6/1981 | Bradshaw | 312/7.2 |

*Primary Examiner*—Victor N. Sakran

*Attorney, Agent, or Firm*—Stephen E. Feldman; Marvin Feldman; Jules L. Chaboty

[57] ABSTRACT

A modular cabinet system comprises a modular unit of a first rectangular cabinet, and a first standing mirror spaced from the cabinet and disposed in the plane of the back side of the rectangular cabinet. A first panel is connected to the standing mirror and to the rectangular cabinet for supporting the standing mirror. In addition a second standing mirror may be spaced from the first standing mirror and a second panel may be connected to these mirrors. A second rectangular cabinet is positioned with its back side adjacent the second panel and extending outward in the same direction as the first rectangular cabinet. Third and fourth rectangular cabinets may be connected into the system and extend outward in an opposite direction from the first and second cabinet. In addition, two mirrors associated with the third and fourth rectangular cabinets are provided adjacent the back surface of the first and second mirrors. Thus multiple modular units may be arranged in different modes to efficiently accommodate various space requirements for hair and beauty salons.

7 Claims, 8 Drawing Figures

FIG. 1
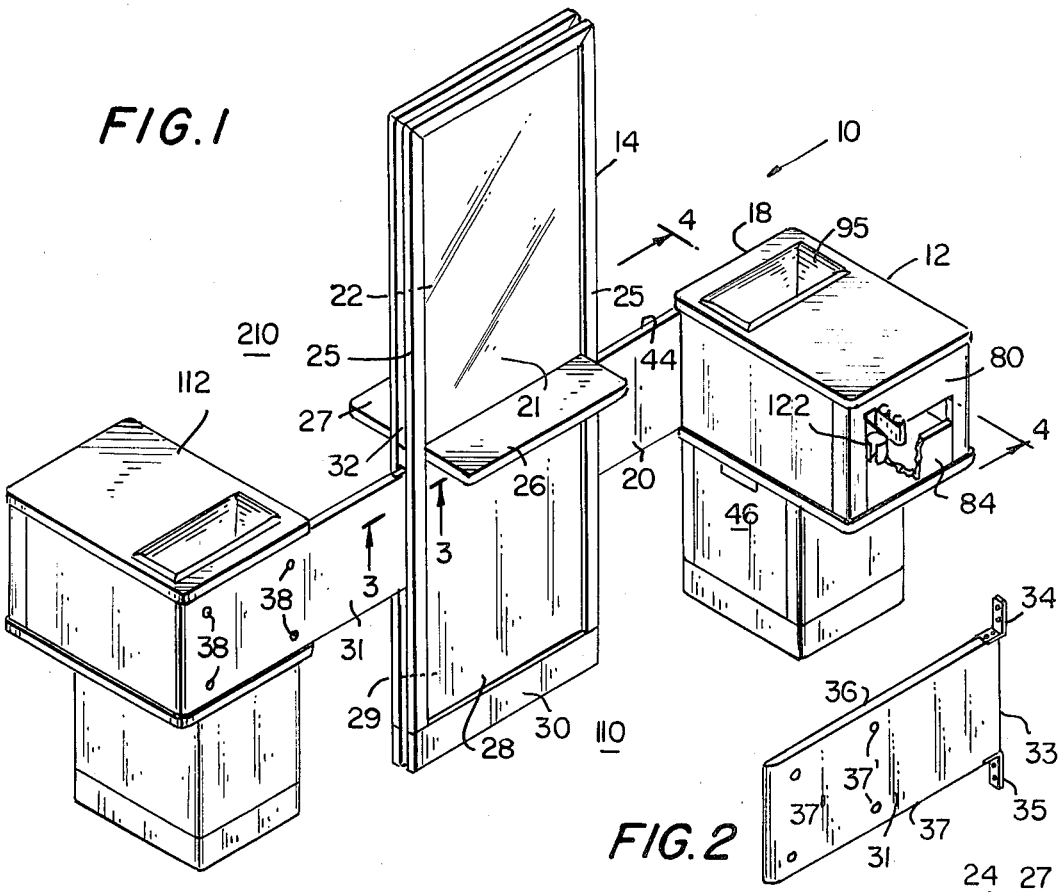
FIG. 2
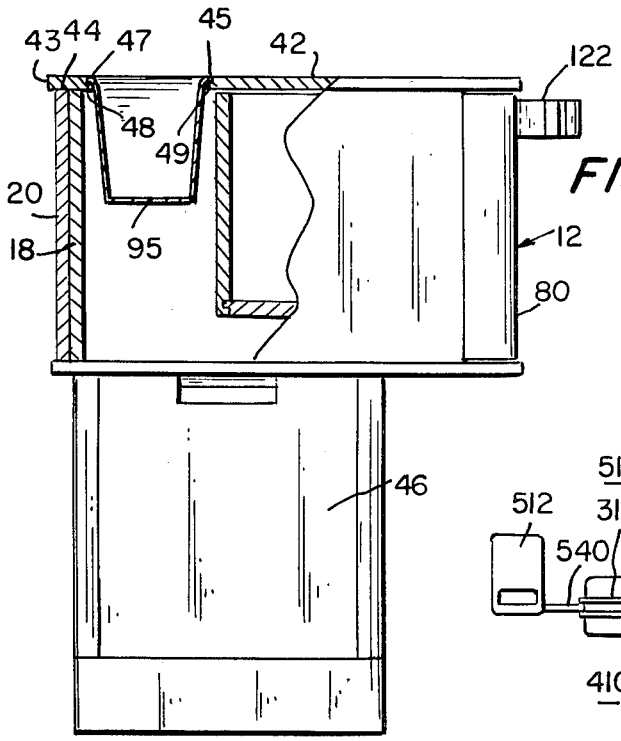
FIG. 4
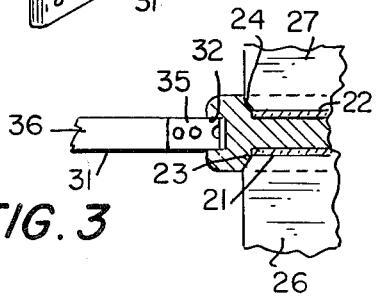
FIG. 3
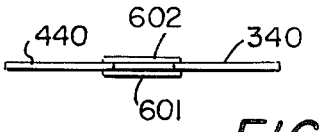
FIG. 8
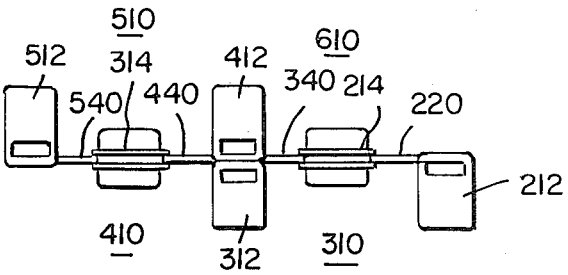
FIG. 7

FIG. 5
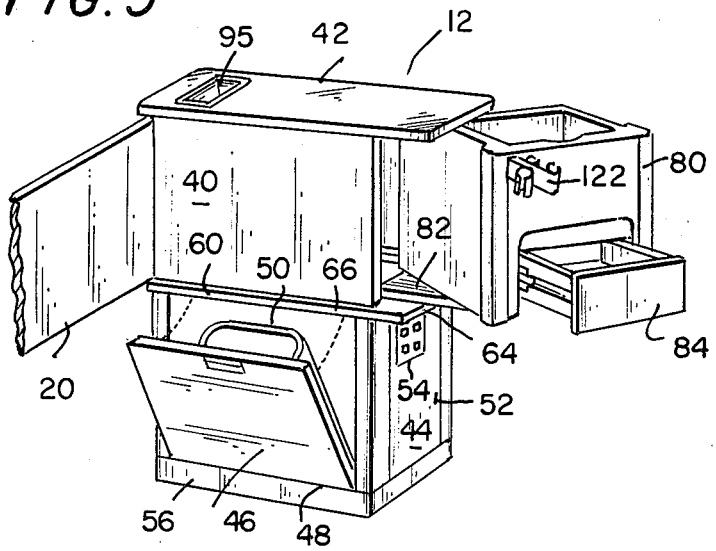
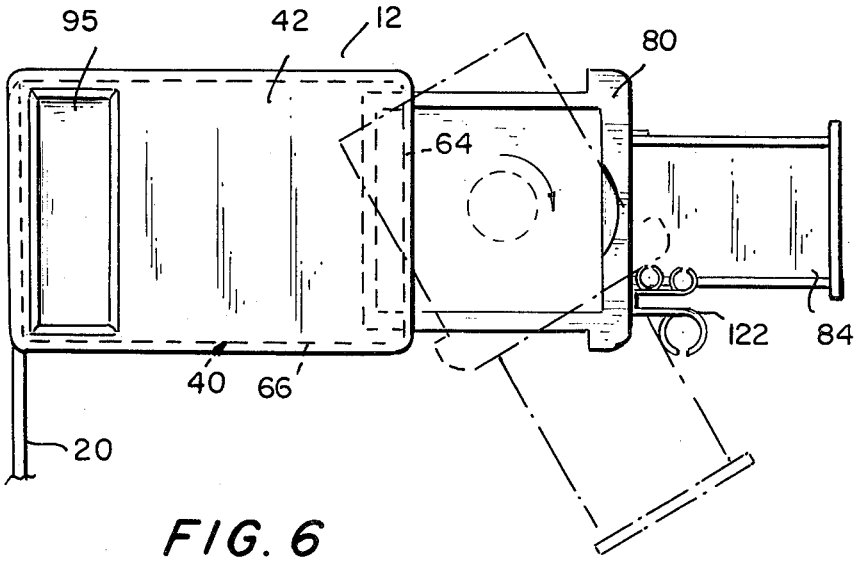
FIG. 6

MODULAR CABINET SYSTEM

FIELD OF THE INVENTION

This invention relates to modular cabinet systems. Specifically this invention relates to modular cabinet and mirror units for efficient space utilization in multiple arrangements.

BACKGROUND OF THE INVENTION

While the present invention is subject to a wide range of applications, it is especially suited for use in a hair dressing salon environment and will be particularly described in that connection.

In general modular cabinets are disclosed in Gutmann, Jr., et al U.S. Pat. No. 3,964,401 granted June 27, 1976 and Canfield, et al, U.S. Pat. No. 4,080,022, granted Mar. 21, 1978, and panel assemblies are disclosed in Parenteau, U.S. Pat. No. 3,955,402, granted Dec. 7, 1976.

In the past, hairdressing salon environments were not generally directed to modular systems, but commonly employed a mirror with a cabinet or vanity located underneath and supporting the mirror. The client sat in front of the mirror while the hairdresser or operator worked behind or next to the client. In this situation, the client was positioned between the hairdressing equipment, storage and work surface. This led to a great deal of wasted motion and time by the operator.

A further development of this system was to provide a free-standing mirror with a cabinet or vanity attached thereto and extending adjacent to the mirror. The cabinet was affixed to the mirror at some desired angle. This provided the tools, storage and work surface adjacent to the operator so that there was a reduction in wasted motion and time since the client did not interfere with the operator. The problem with this arrangement was the inflexibility in changing the position between the vanity and the mirror depending upon the particular layout of the beauty salon or the specific needs of the operator. For example, the operator may require more space between the client's chair and the vanity than could be provided.

This latter described system was useful in beauty salons having particular floor layouts. However, in the situations where a larger number of cabinets and vanities were required, the system did not provide the necessary flexibility. There developed a need to construct the system from modular units which were relatively easy to transport, increase or decrease in size, and capable of using a relatively small floor layout to accomodate a large number of work spaces.

It is an object of the present invention to provide a modular cabinet system which substantially obviates one or more of the limitations and disadvantages of the described prior art arrangements.

It is a further object of the present invention to provide an improved modular cabinet system which allows a number of mirrors and cabinets to be readily joined together.

It is a still further object of the present invention to provide a modular cabinet system wherein cabinets and associated mirrors may be joined together and facing in opposite directions to provide a large number of discrete work places in a relatively small area.

SUMMARY OF THE INVENTION

Accordingly, there has been provided a modular cabinet system comprising a first rectangular cabinet. A first standing mirror is spaced from the cabinet and disposed in the plane of the back side of the rectangular cabinet. A first panel is connected to the standing mirror and to the rectangular cabinet for supporting the standing mirror. In addition a second standing mirror may be spaced from the first standing mirror and a second panel may be connected to these mirrors. A second rectangular cabinet is positioned with its back side adjacent the second panel and extending outward in the same direction as the first rectangular cabinet. Third and fourth rectangular cabinets may be connected into the system and extend outward in an opposite direction from the first and second cabinet. In addition, two mirrors associated with the third and fourth rectangular cabinets are provided adjacent the back surface of the first and second mirrors.

For a better understanding of the present invention, together with other and further objects thereof, referernce is had to the following description, taken in connection, with the accompanying drawings, while its scope will be pointed out in the appended claims.

BRIEF DESCRIPTION OF THE DRAWINGS

FIG. 1 is a perspective view of a modular cabinet system in accordance with the present invention;

FIG. 2 is an enlarged perspective view of the end panel shown in FIG. 1;

FIG. 3 is an enlarged partial sectional view taken along line 3—3 of FIG. 1;

FIG. 4 is an enlarged fragmentary sectional view taken along line 4—4 of FIG. 1;

FIG. 5 is a partial enlarged perspective view of the cabinet;

FIG. 6 is an enlarged plan view of the cabinet with the drawer open;

FIG. 7 is a plan view of another embodiment incorporating the invention; and FIG. 8 is a plan view of the connecting panes showing a modification used in the construction of FIG. 7.

DESCRIPTION OF THE PREFERRED EMBODIMENT OF THE INVENTION

Referring to FIGS. 1–4, there is disclosed a modular system 10 which comprises a first rectangular cabinet 12, and a first standing mirror assembly 14 spaced from the cabinet 12 and disposed in a parallel plane to the back side 18 of the rectangular cabinet 12. A panel 20 is connected to the mirror 14 and the rectangular cabinet 12 for supporting the standing mirror. Cabinet 12 comprises components including a swivel drawer 80, a waste bin or hamper 46, an implement holder 122, and a wet pan 95, all of the aforesaid for use during hair dressing operations, as will be more fully explained in connection with FIGS. 5 and 6.

Mirror assembly 14 comprises a pair of opposed mirrored surfaces 21 and 22 which are received in recessed portions 23, 24, respectively of support frame elements 25. Support frame elements 25 extend around the periphery and rest in support base piece 30. A pair of oppositely disposed ledges 26 and 27 are fixedly mounted within frame elements 25 and serve as convenient ledges for materials needed in hair dressing operations. There are non-mirrored surfaces 28 and 29 disposed below the ledges 26, 27 which surfaces are also mounted within frame elements 25 in a manner similar to the mirrored surfaces. Non-mirror surfaces may be formed of wood and serve as protection as well as appearance coordination with the cabinet wood grain.

A second panel 31 is disposed on the opposite side of mirror assembly 14, and is similar in construction to panel 20. Frame 25 is formed with a longitudinal groove 32 for receiving end 33 of panel 31 (FIG. 3). Panel 31 is formed with two angle brackets 34 and 35 which are oppositely mounted on the top 36 and bottom 37 of panel 31, as best shown in FIG. 2. Brackets 34 and 35 are disposed with groove 32 and are received into the frame 25 so as to be disconnectably fixed to the mirror assembly 14.

The other end 36 of panel 31 is formed with four through holes 37' (typical) for receiving bolts 38 (typical) so as to connect the panel to the back or rear of cabinet 112. Cabinet 112 is similar in construction to cabinet 12 but is oppositely disposed to cabinet 12.

In this manner of construction the two cabinets 12 and 112 affixed to the single mirror assembly 14 form two distinct, non-interferring work stations 110 and 210, in which salon chairs (not shown) are provided.

Referring specifically to FIG. 4, there is shown cabinet 12 in some detail, with the drawer 84 removed. Cabinet 12 is formed with a top 42 which is provided with an overhang lip 43 which extends rearwardly of back 18. Lip 43 rests on the top 44 of panel 20 with the panel mounted to the back 14. This mounting aspect is best shown for cabinet 112 in FIG. 1. Top 42 is formed with a cut-out 45, into which is received pan 95. Pan 95 is formed with lip 47 which rests on groove 48 and there is a resilient strip 49 to provide both a snug fit as well as to seal the pan. The pan is used for wet materials. Drawer 80 is received within the body of cabinet 12.

Referring to FIGS. 5 and 6, there is illustrated a cabinet 12 in accordance with the present invention. The cabinet 12 includes a body structure 40 having a top member 42 affixed to the body structure. The body structure includes a lower section 44 having a hamper 46 therein. The hamper is hinged along its bottom edge 48 and may contain a removable waste basket 50 carried therein as best seen in FIG. 5. This hamper may be used by the operator to throw in towels or any other items that need to be discarded. A side panel 52 of the lower section may be provided with a conventional four-way outlet 54 to provide power for different accessories used by the operator as will be further described. The lower section may preferably be supported by a base support 56 whereby the hamper 46 can easily be opened. The lower section includes a top member 60. The top member provides a support base for the upper section 40 as best seen in FIG. 6. Top member 60 has a side edge 64 extending substantially perpendicular to edge 66. A swivel drawer 80 is disposed between the front and rear parallel panels and extends from the side of the upper section opposite to the connection with the mirror.

The details of the swivel drawer 80 can best be seen in FIGS. 5 and 6. The swivel drawer 80 sits on a conventional extension chassis but with a built in swivel. As seen in FIG. 5, a base 82 moves in and out of the upper section on telescopic extensions. A plate, carried by the base, supports the drawer and is able to turn and allow the drawer to swivel approximately 60 degrees through its center of rotation after the drawer is pulled out. Further, the drawer may include drawer 84 therein. This provision of the swivel drawer is quite significant. When an operator is standing next to a client, it is very easy and efficient to reach any of the required hairdressing tools which are stored either within the swivel drawer or the drawer 84.

Implement holder 122 is affixed to a support plate and is capable of holding a plurality of heat producing implements such as hair blowers. The implement holder 122 has generally cylindrical portions with cooling slots extending the length of the cylinders for dispersing heat which builds up in the walls of the cylinder or in the heat producing implements.

Referring to FIG. 7, there is shown a further arrangement embodying the invention. This further embodiment, encompasses in series, cabinet 212, panel 220, mirror assembly 214, panel 340, back-to-back cabinets 312, 412, panel 440, mirror assembly 314, panel 540 and cabinet 512. In this manner of arrangement, four discrete operating areas 310, 410, 510 and 610 are provided, thus utilizing the space to a highly efficient and flexible degree.

It is to be noted that in the FIG. 8 embodiment, cabinets 312 and 412 are mounted back-to-back and insofar as the lips are designed to overhang the panel, special shim pieces 601 and 602 are mounted between the back sides of the cabinets and the panels 340 and 440 (FIG. 6), to permit the mounting overhanging lips to meet in flush contact.

While there has been described what is at present considered to be the preferred embodiments of the invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. A modular cabinet system comprising:

(a) a first rectangular cabinet, (b) a first standing mirror, said first standing mirror being spaced from said first rectangular cabinet and disposed in a parallel plane to the back side of said first rectangular cabinet, (c) a first panel comprising connecting means disposed at its ends so as to connect one end to said first standing mirror and at the other end to said first rectangular cabinet, whereby said first panel supports said first standing mirror, (d) a first swivel drawer, said first swivel drawer extending from a first side of said first rectangular cabinet, to provide easy access to said first drawer at a location in front of said first standing mirror, (e) a second standing mirror, said second standing mirror being spaced from and in the same plane as said first standing mirror, (f) a second panel, said second panel being connected to said first and second standing mirrors, (g) a second rectangular cabinet having a back side adjacent said second panel and extending outward in the same direction as said first rectangular cabinet, (h) a second swivel drawer, said second swivel drawer extending outward from the front side of said second rectangular cabinet, to provide easy access to said second swivel drawer at a location in front of said second standing mirror, (i) a third rectangular cabinet, said third rectangular cabinet being disposed on the opposite side of said second standing mirror from said second rectangular cabinet, (j) a third panel, said third panel being in the plane of said second standing mirror and connecting said third rectangular cabinet to said second standing mirror, whereby the front side of said third standing mirror faces an opposite direction from the front sides of said first and second rectangular cabinets, and (k) a third standing mirror affixed adjacent the back side of said second standing mirror.

2. The modular cabinet system of claim 1 including a third swivel drawer extending from a front side of the third cabinet to provide easy access to the drawer at a location in front of the third mirror.

3. The modular cabinet system of claim 2, including a fourth rectangular cabinet having a back side disposed adjacent to the second panel and opposite the back side of the second rectangular cabinet, and a fourth standing mirror affixed adjacent to the back side of the first mirror.

4. The modular cabinet system of claim 3 including a fourth swivel drawer extending from the front side of the fourth cabinet to provide easy access to the drawer at a location in front of the fourth mirror.

5. The modular cabinet system of claim 3, wherein each of said mirrors is held in a frame having a longitudinal groove along both sides for receiving the panels whereby they are connected to the mirrors.

6. The modular cabinet system of claim 3, wherein each of said mirrors has a shelf extending therefrom.

7. The modular cabinet system of claim 1, further comprising cabinet being oppositely disposed to said first cabinet so as to back-to-back, said cabinets comprising tops which overhang the respective back sides, and shim means being disposed between each of the respective back sides and opposite sides of the panel.

* * * * *